United States Patent [19]

Yonkers

[11] 4,408,912

[45] Oct. 11, 1983

[54] RIBBON CARTRIDGE WITH SHIELD

[75] Inventor: Edward Yonkers, Newton, Mass.

[73] Assignee: Data Packaging Corporation, Cambridge, Mass.

[21] Appl. No.: 219,904

[22] Filed: Dec. 24, 1980

Related U.S. Application Data

[63] Continuation-in-part of Ser. No. 78,653, Sep. 24, 1979, abandoned.

[51] Int. Cl.[3] ..... B41J 33/10

[52] U.S. Cl. ..... 400/208; 400/248

[58] Field of Search ..... 400/194, 195, 196, 196.1, 400/208, 208.1, 214, 247, 248

[56] References Cited

U.S. PATENT DOCUMENTS

| | | | |
|---|---|---|---|
| 2,873,015 | 2/1959 | Gray | 400/208.1 |
| 3,017,981 | 1/1962 | Keith | 400/248 |
| 3,904,017 | 9/1975 | Frechette | 400/208 X |
| 3,905,465 | 9/1975 | Frechette et al. | 400/214 |
| 3,941,231 | 3/1976 | Matuck et al. | 400/248 X |
| 3,964,595 | 6/1976 | Edstrom | 400/208 X |
| 4,046,247 | 9/1977 | Laspesa et al. | 400/196 |
| 4,074,800 | 2/1978 | Steinke | 400/195 |
| 4,165,188 | 8/1979 | Rempel | 400/248 X |
| 4,325,645 | 4/1982 | Miyajima et al. | 400/248 X |

FOREIGN PATENT DOCUMENTS

| | | | |
|---|---|---|---|
| 2757993 | 6/1979 | Fed. Rep. of Germany | 400/208 |

*Primary Examiner*—Ernest T. Wright, Jr.
*Attorney, Agent, or Firm*—Wolf, Greenfield & Sacks

[57] ABSTRACT

A ribbon cartridge for high speed printers having a main ribbon storage casing and a pair of arms which extend in generally the same direction from the casing. The ends of the arms form an exposed ribbon path to allow the printhead to strike the ribbon. A shield is provided in front of the ribbon to prevent the accordion folds of the paper from engaging and lifting the ribbon out of the path of the printhead.

6 Claims, 9 Drawing Figures

RIBBON CARTRIDGE WITH SHIELD

RELATED APPLICATION

This is a continuation-in-part of application Ser. No. 78,653 filed Sept. 24, 1979, now abandoned.

INTRODUCTION

This invention relates to matrix or other impact type printers and more particularly comprises a new and improved ribbon cartridge used in such printers.

The accordion folded paper used in impact printers is very frequently quite thick and bulky because of the number of layers of paper in the pack. For example, it is very common to utilize six layer paper (one original and five copy sheets), and the perforations at the accordion folded edges have a tendency to engage the ribbon of the printer cartridge and displace it out of the path of the printhead, resulting in a malfunction of the machine.

The object of the present invention is to provide a ribbon cartridge for such printers which prevents the paper, regardless of its bulk, from engaging and displacing the ribbon.

A more specific object of the present invention is to provide a ribbon cartridge which has a special shield to protect the ribbon and which may be used on conventional printers without requiring their modification.

Yet another object of the present invention is to provide an economical ribbon cartridge for high-speed printers that has a shield to protect the ribbon from the upward travel of the paper by essentially covering the entire exposed ribbon path.

To accomplish these and other objects, the cartridge of the present invention includes a shield which extends between the cartridge arms in front of the exposed ribbon path. A bridge which joins the arms of the cartridge supports the shield, and the shield may be provided with a fold adjacent the bottom to deflect the paper as it moves upwardly by it. A window in the shield allows the printhead to force the ribbon against the paper face so as to leave an impression on the paper and yet prevents the paper from displacing the ribbon.

These and other objects and features of this invention will be better understood and appreciated from the following detailed description of one embodiment thereof selected for purposes of illustration and shown in the accompanying drawing, in which:

DETAILED DESCRIPTION OF THE DRAWING

Figure 1:
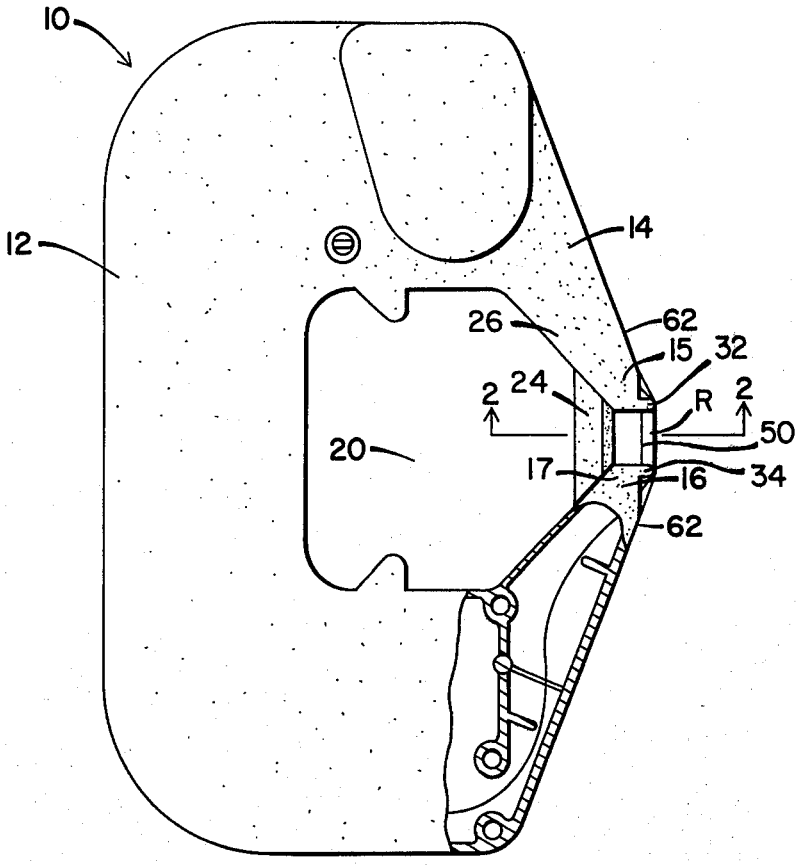
FIG. 1 is a plan view of a ribbon cartridge constructed in accordance with my invention.

The cartridge 10 shown in FIG. 1 is of the type used on an impact dot matrix printer and contains an endless loop of ribbon R which is randomly packed in the cartridge 10. The ribbon R typically may be 20 to 100 yards in length and is automatically advanced in the cartridge 10 by gears (not shown) actuated by a drive on the printer. As shown, the cartridge 10 generally includes a case section 12 and a pair of arms 14 and 16 that converge toward one another from the ends of the case section 12. The arms 14, 16 and case section 12 define an opening 20 into which the printhead H extends and which impacts the ribbon R and causes it to leave an impression on the paper P' in the printer. This technology is well known and forms no part of the invention.

Figure 3:
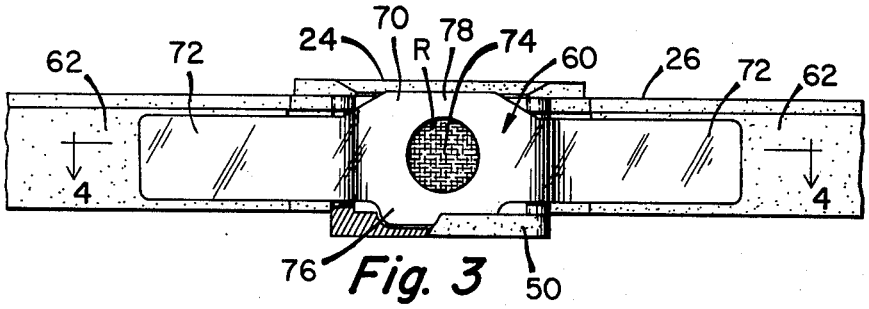
FIG. 3 is a fragmentary front view of the cartridge looking in the direction of the ribbon shield.
Figure 4:
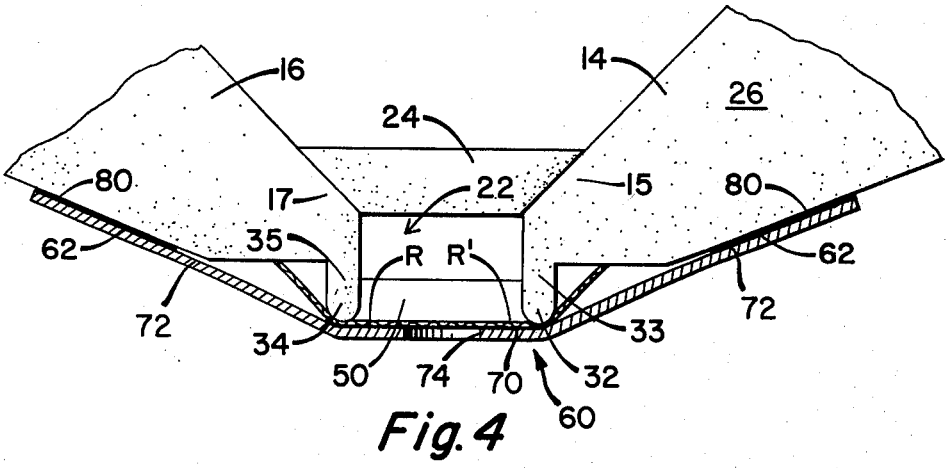
FIG. 4 is a fragmentary cross-sectional view taken along the section line 4—4 in FIG. 3.
Figure 5:
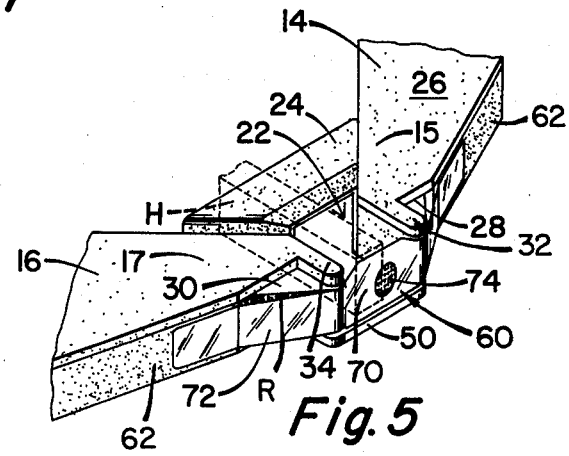
FIG. 5 is a fragmentary perspective view of the front portion of the cartridge.

As shown in FIGS. 3–5, the arms 14 and 16 are spaced apart to form a gap 22 across which the ribbon R extends, exposed so as to be engagable by the printhead H. In the embodiment shown, the gap 22 between the arms 14 and 16 is approximately ½ inch, but the gap 22 varies from cartridge to cartridge depending upon the machine for which it is designed. The ends 15 and 17 of the arms 14 and 16, respectively, are joined by a strut 24 just above the plane of the upper surface 26 of the cartridge 10 and displaced from the gap 22 so as not to interfere in any way with the printhead H which must engage the inner surface R' of the ribbon R.

In FIGS. 4 and 5, the ribbon R is shown to extend through openings 28 and 30 in the front face of the ends 15 and 17 of arms 14 and 16 (normally emerging from opening 30 and re-entering the cartridge 10 through opening 28). A pair of vertical guide posts 32 and 34 formed on the ends of flanges 33 and 35 that are in integral part of the cartridge 10, define the vertical plane of the ribbon R as it spans the gap 22.

Figure 7:
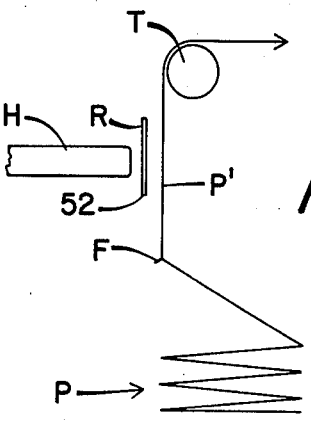
FIG. 7 is a diagrammatic view suggesting the accordion folded paper, ribbon and printhead presented to illustrate the problems overcome by the present invention.

In FIG. 7 the problem of ribbon displacement commonly encountered with cartridges of this type is illustrated. The zig-zag line near the bottom of the figure represents an accordion folded paper pack P which normally is multipart paper, that is, having more than one layer. Frequently, such paper includes up to six sheets, namely, an original and five copies, and consequently the paper is quite bulky. The bulk of the paper pack P is frequently exaggerated by air between the sheets, which inflates the pack thickness. In FIG. 7 a ribbon R is shown disposed behind the fold of paper P' disposed in the print plane, and a printhead H is suggested, which is intended to engage the ribbon R and press it forward against the sheet P' so as to print the desired impression. At F, a projection is suggested at the fold at the bottom of the panel of paper P', which may be formed by the perforations in the paper at the fold. The edge of corner projection F as will be appreciated from FIG. 7, may engage the lower edge of the ribbon R as the paper P' is drawn upwardly by the transport T and displace the ribbon R from its normal position in front of the printhead H. When that occurs, actuation of the printhead H does not leave the printed impression on the paper P' and the information may be lost. The present invention prevents just such an occurrence.

In accordance with the present invention, a bridge 50 extends across the gap 22 between the bottoms of the flanges 33 and 35 and below the elevation of the lower edge 52 of ribbon R. The front edge 54 of the bridge 50 extends slightly forward of the plane of ribbon R, and a recess 56 is provided in the top surface 58 of the bridge 50 approximately in front of the plane of the ribbon R. The shield 60 is supported on the bridge 50 and the front surface 62 of the arms 14 and 16.

Figure 6:
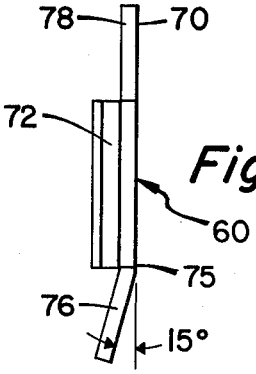
FIG. 6 is a side view of the ribbon shield.

The shield 60 includes a central panel 70 and a pair of outwardly extending wings 72. The central panel 70 has a window 74 aligned with the ribbon R and the printhead H suggested in broken lines in FIG. 5. A tab 76 is formed along the bottom edge of the panel 70 and is bent slightly rearwardly as shown in FIG. 6. The tab 76 is preferably bent at a 15° angle as shown in FIG. 6. The tab 76 is sized to be inserted into recess 56, and the bend in the shield 60 at the tab 76 serves to deflect the folds of the paper P' as they move upwardly, away from the plane of ribbon R. A similar tab 78 may be formed at the top edge of the panel 70 as shown in FIGS. 3 and 6. Panel 70 is approximately the same width as the ribbon R, and the tab 78 extends above the ribbon upper edge to provide additional protection for it. Wings 72 which extend rearwardly in the plane of the front surfaces 62 of the arms 14 and 16 of the cartridge 10 are secured to those surfaces 62 by a coating of adhesive 80. The adhesive 80 may conveniently be applied to the rear surfaces of the wings 72 prior to installation of the shield 60.

It will be appreciated that the shield 60 covers the entire exposed ribbon R between the points of entry and exit to and from the openings 28 and 30 in the arms 14 and 16, and the printing occurs only through window 74. The bridge 50 itself and the fold 75 at the top of tab 76 in the shield 60 act as deflectors forcing the thick, puffy multipart paper P' forward and out of the way so that the ribbon R cannot be caught.

Figure 8:
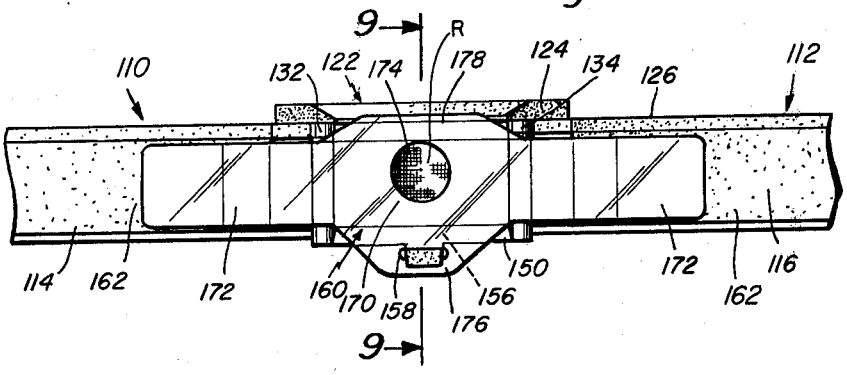
FIG. 8 is a fragmentary front view of an alternate embodiment of the cartridge looking in the direction of the ribbon shield.
Figure 9:
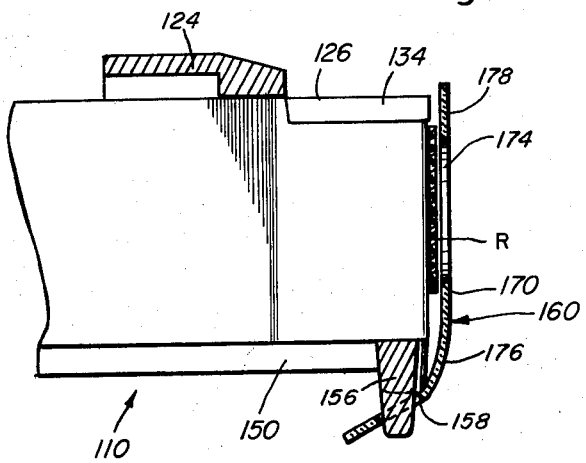
FIG. 9 is a cross-sectional view taken along line 9—9 of FIG. 8.

FIG. 8 is a fragmentary front view of an alternate preferred embodiment of a cartridge 110 looking in the direction of the ribbon shield 160. FIG. 9 is a cross-sectional view taken along line 9—9 of FIG. 8. The cartridge 110 depicted in FIGS. 8 and 9 is in substance identical to the cartridge 10 depicted in FIG. 1 and is for use on an impact dot matrix printer. The cartridge 110 contains an endless loop of ribbon R which is randomly packed in the cartridge 110. The ribbon R typically is advanced in the cartridge 110 by gears or other means actuated by a drive means on the printer.

As in the first embodiment disclosed herein, the cartridge 110 includes a case section 112 and a pair of arms 114 and 116 that converge toward one another from the ends of the case section 112. The arms 114, 116 and case section 112 define an opening into which the printhead H extends and which impacts the ribbon R and causes it to leave an impression on the paper P' in the printer.

The arms 114 and 116 are spaced apart to form a gap 122 therebetween across which the ribbon R extends, exposed so as to be engagable by the printhead H. As in the previous embodiment, in the embodiment of FIGS. 8 and 9, this gap 122 may be on the order of one-half inch. The ends of the arms 114 and 116, are joined by a strut 124 just above the plane of the upper surface 126 of the cartridge 110. The strut 124 is disposed so as not to interfere in any way with the printhead H which must engage the inner surface of the ribbon R.

As with the first embodiment disclosed herein, in the preferred embodiment of FIGS. 8 and 9, the ribbon R extends through openings in the front face of the ends of the arms 114 and 116. In this regard, reference is made to FIG. 4 which shows the course of the ribbon R which may be substantially the same course taken by the ribbon R in the embodiment of FIG. 8. A pair of vertical guide posts 132 and 134 define at the very end of the arms 114 and 116, respectively, the vertical plane of the ribbon R as it spans the gap 122.

In the embodiment of FIGS. 8 and 9, the shield 160 is provided to solve the same problems previously discussed with regard to the illustration of FIG. 7, namely the problem of ribbon displacement commonly encountered with cartridges of this type. Basically, the shield 160 prevents a snagging of the paper P' as it traverses by the ribbon R and, thus, prevents any ribbon displacement which is undesirable. When a ribbon displacement occurs, the printed impression on the paper P' may be lost.

Figure 2:
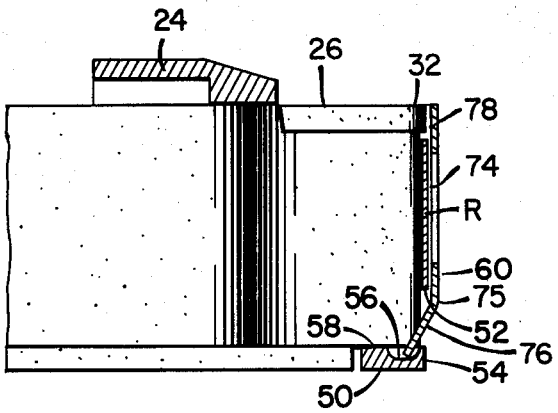
FIG. 2 is a cross-sectional view taken along the corresponding section line 2—2 in FIG. 1.

In accordance with the preferred embodiment of the invention as depicted in FIGS. 8 and 9, there is provided a bridge 150 which extends across the gap 122 between the bottoms of the flanges defining the guide posts 132 and 134 below the elevation of the lower edge of the ribbon R. In this embodiment the bridge 150 is disposed inwardly of the plane of the ribbon R, and in place of the recess 56 in the bridge 50 depicted in FIG. 2, as depicted in FIG. 9, the bridge 150 is provided with a tab 156 which is adapted to be inserted in the hole 158 in the shield 160. Actually, as depicted in FIG. 8, the hole 158 is of a slot-dash shape. The shield 160 is supported on the bridge 150 and, also, on the front surface 162 of the arms 114 and 116.

The shield 160 includes a central panel 170 and a pair of outwardly extending wings 172. The central panel 170 has a window 174 aligned with the ribbon R and the printhead H which may be in a position previously suggested in FIG. 5. A tab 176 is formed along the bottom edge of the central panel 170 and is adapted to be bent rearwardly as shown in FIG. 9. It is the tab 176 that is provided with the through slot 158. In this regard, the tab 176 shown in FIG. 8 is preferably of greater height than the tab 76 previously described in connection with the first embodiment described herein. Another tab 178 is also preferably formed at the top edge of the panel 170 as depicted in FIGS. 8 and 9. The central panel 170 itself is approximately the same width as the ribbon R, and a tab 178 extends above the ribbon upper edge to provide additional protection for it. Wings 172, which extend rearwardly in the plane of the front surfaces 162 of the arms 114 and 116, are secured to those surfaces by a coating of adhesive. The adhesive may be conveniently applied to the rear surfaces of the wings 172 prior to installation of the shield 160. Of course, the tab 156 associated with the bridge 150 is engaged with the slot 158 prior to the adhesive securing of the wings 172 of the shield 160.

In practice the second embodiment described herein, in FIGS. 8 and 9 has been found to be the preferred embodiment and from a practical standpoint this preferred arrangement provides improved operational results and provides a more well-secured arrangement of the shield 160.

Having described the invention in detail, those skilled in the art will appreciate that numerous modifications may be made of the illustrated embodiment without departing from the spirit of the invention. Therefore, I do not intend to limit the invention to the single embodiment shown and described. Rather, its scope is to be determined by the appended claims and their equivalents.

What is claimed is:

1. A ribbon cartridge for high speed printers having a printhead and paper to be printed thereon, comprising:

a main ribbon storage compartment and a pair of arms extending generally in the same direction from the compartment, a ribbon stored in the compartment and extending from one arm and entering the other of the arms, a gap between the arms defining an exposed ribbon path essentially parallel to the print plane of the printer and between the plane of the paper on which the printing is to occur and the printhead, a bridge joining the arms below the lower edge of the ribbon in the gap, a shield mounted in part by the bridge and lying on the side of the ribbon facing the paper, said shield preventing the paper from engaging and displacing the ribbon from the ribbon path, and having a substantially flat central panel extending across the gap, a window in the shield through which the printhead may engage the ribbon to make an impression on the paper, said shield further having oppositely directed end wings extending from said flat central panel in a direction out of the plane of the central panel and extending rearwardly, said pair of arms each having a front surface extending from the gap, and means adhesively securing each wing to the compartment arm front surfaces.

2. A ribbon cartridge for high speed printers as defined in claim 1 further characterized by a recess in the upper surface of the bridge, and a tab forming part of the shield and engaging in the recess to support the shield.

3. A ribbon cartridge for high speed printers as defined in claim 1 further characterized by a bend in the shield causing the tab to incline rearwardly and downwardly from the vertical, said bend deflecting any folds in the paper from the plane of the ribbon in the gap as the paper moves upwardly in front of the ribbon.

4. A ribbon cartridge for high speed printers as defined in claim 1 further characterized by a tab on the bridge extending downwardly, and a slot in the shield receiving the tab on the bridge to lock the shield to the bridge.

5. A ribbon cartridge for high speed printers as defined in claim 1 further characterized by said bridge having a most-forward edge along the gap terminating rearwardly of the shield central panel.

6. A ribbon cartridge for high speed printers having a printhead and paper to be printed thereon, comprising:

a main ribbon storage compartment and a pair of enclosed arms extending generally in the same direction from the compartment, the ends of the arms being spaced apart to form a gap with the ribbon emerging only from an opening at the end of one arm and reentering the cartridge only through an opening at the end of the other arm, a ribbon stored in the compartment and extending from the opening of one arm and entering the opening in the other arm, the ribbon exposed in the gap being positioned to be engaged by the printhead against the paper in the print plane of the ribbon, said gap between the arms defining an exposed ribbon path essentially parallel to the print plane of the printer and between the plane of the paper on which the printing is to occur and the printhead, a bridge joining the arms below the lower edge of the ribbon in the gap, a shield mounted in part by the bridge and lying on the side of the ribbon facing the paper, said shield preventing the paper from engaging and displacing the ribbon from the ribbon path, and having a vertical substantially flat central panel extending across the gap, said shield in addition to the central panel having oppositvely directed end wings each having means securing each wing to the compartment arms on the outer exposed surface of the arms with the wings extending in a direction out of the plane of the central panel and extending rearwardly, and a window in the shield through which the printhead may engage the ribbon to make an impression on the paper, said shield mounted to the bridge comprising a tab bent rearwardly and downwardly of the vertical flat central panel of said shield to engage with tab engaging means on the bridge, said tab and vertical flat central panel defining a bend with the bend deflecting any folds in the paper from the plane of the ribbon in the gap as the paper moves upwardly in front of the ribbon.

* * * * *